US009393453B2

(12) United States Patent
Watterson

(10) Patent No.: US 9,393,453 B2
(45) Date of Patent: Jul. 19, 2016

(54) EXERCISE DEVICE WITH VIBRATION CAPABILITIES

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 154 days.

(21) Appl. No.: 14/091,064

(22) Filed: Nov. 26, 2013

(65) Prior Publication Data

US 2014/0162854 A1 Jun. 12, 2014

Related U.S. Application Data

(60) Provisional application No. 61/730,301, filed on Nov. 27, 2012.

(51) Int. Cl.

| | |
|---|---|
| ***A63B 21/00*** | (2006.01) |
| ***A63B 21/055*** | (2006.01) |
| ***A63B 23/04*** | (2006.01) |
| ***A63B 23/12*** | (2006.01) |
| ***A63B 24/00*** | (2006.01) |
| *A61H 23/02* | (2006.01) |

(52) U.S. Cl.

CPC ..... *A63B 21/00196* (2013.01); *A63B 21/00069* (2013.01); *A63B 21/00072* (2013.01); *A63B 21/0557* (2013.01); *A63B 21/156* (2013.01); *A63B 21/4029* (2015.10); *A63B 21/4035* (2015.10); *A63B 21/4049* (2015.10); *A63B 23/0494* (2013.01); *A63B 23/1218* (2013.01); *A63B 23/1254* (2013.01); *A63B 23/1263* (2013.01); *A63B 23/1272* (2013.01); *A63B 24/0087* (2013.01); *A61H 2023/0281* (2013.01); *A61H 2201/1633* (2013.01); *A61H 2201/1635* (2013.01); *A61H 2205/06* (2013.01); *A63B 2220/64* (2013.01); *A63B 2225/09* (2013.01); *A63B 2225/093* (2013.01)

(58) Field of Classification Search

CPC ..... A63B 21/062; A63B 21/154; A63B 21/1492; A63B 21/156; A63B 21/1469; A63B 21/0552; A63B 23/12; A63B 21/1457; A63B 21/00196; A63B 21/00069; A63B 21/055; A63B 21/06; A63B 2208/0204

USPC ..... 482/92, 138, 139

See application file for complete search history.

(56) References Cited

U.S. PATENT DOCUMENTS

| | | | | |
|---|---|---|---|---|
| 3,205,888 | A | 9/1965 | Stroop | |
| 3,851,874 | A * | 12/1974 | Wilkin | 482/92 |
| 4,958,832 | A | 9/1990 | Kim | |
| 6,238,323 | B1 * | 5/2001 | Simonson | 482/103 |
| 6,488,612 | B2 * | 12/2002 | Sechrest et al. | 482/103 |
| 6,918,859 | B1 | 7/2005 | Yeh | |
| 7,166,067 | B2 | 1/2007 | Talish et al. | |

(Continued)

*Primary Examiner* — Stephen Crow
*Assistant Examiner* — Andrew S Lo
(74) *Attorney, Agent, or Firm* — Holland & Hart LLP

(57) ABSTRACT

An exercise device includes a frame having a cable and pulley system connected thereto. The cable and pulley system includes at least one pulley and at least one cable strand. The at least one cable strand has a handle connected thereto for use in performing exercises. One or more vibration assemblies are connected to the at least one pulley in order to vibrate the at least one cable strand. The vibrations from the vibration assemblies are transferred to a user during the performance of exercise to provide various physiological benefits to the user.

16 Claims, 11 Drawing Sheets

(56) References Cited

U.S. PATENT DOCUMENTS

| | | | | |
|---|---|---|---|---|
| 7,238,143 | B1 * | 7/2007 | Sokolovos et al. | 482/1 |
| 7,322,948 | B2 | 1/2008 | Talish et al. | |
| 7,335,141 | B2 * | 2/2008 | Piane, Jr. | 482/99 |
| 7,534,200 | B1 * | 5/2009 | Martinez | 482/142 |
| 7,608,024 | B2 * | 10/2009 | Sechrest et al. | 482/103 |
| 7,682,287 | B1 * | 3/2010 | Hsieh | A63B 21/00196 482/1 |
| 7,811,202 | B2 * | 10/2010 | Planke | 482/7 |
| 7,815,552 | B2 * | 10/2010 | Dibble et al. | 482/92 |
| 7,871,355 | B2 | 1/2011 | Yeh | |
| 7,892,155 | B2 * | 2/2011 | Pearson et al. | 482/121 |
| 8,057,367 | B2 * | 11/2011 | Giannelli et al. | 482/102 |
| 8,096,926 | B1 * | 1/2012 | Batca | 482/99 |
| 8,251,877 | B2 * | 8/2012 | Rasmussen et al. | 482/100 |
| 8,506,459 | B2 * | 8/2013 | Cassidy et al. | 482/94 |
| 8,517,899 | B2 * | 8/2013 | Zhou et al. | 482/71 |
| 2002/0098957 | A1 * | 7/2002 | Webber | 482/138 |
| 2003/0032535 | A1 * | 2/2003 | Wang et al. | 482/138 |
| 2004/0176226 | A1 * | 9/2004 | Carlson | 482/112 |
| 2005/0014616 | A1 * | 1/2005 | Tiahrt | 482/133 |
| 2005/0181918 | A1 * | 8/2005 | Sumners et al. | 482/148 |
| 2005/0250626 | A1 * | 11/2005 | Charnitski | 482/92 |
| 2007/0190508 | A1 | 8/2007 | Dalton | |
| 2007/0207902 | A1 * | 9/2007 | Tiahrt | 482/72 |
| 2008/0139370 | A1 * | 6/2008 | Charnitski | 482/139 |
| 2008/0207407 | A1 | 8/2008 | Yeh | |
| 2008/0214971 | A1 | 9/2008 | Talish et al. | |
| 2008/0279896 | A1 | 11/2008 | Heinen et al. | |
| 2009/0118098 | A1 | 5/2009 | Yeh | |
| 2009/0270234 | A1 * | 10/2009 | Alessandri et al. | 482/129 |
| 2010/0063426 | A1 * | 3/2010 | Planke | 601/46 |
| 2010/0069202 | A1 * | 3/2010 | Olsen | 482/5 |
| 2010/0087298 | A1 * | 4/2010 | Zaccherini | 482/139 |
| 2010/0210418 | A1 | 8/2010 | Park | |
| 2010/0255965 | A1 * | 10/2010 | Chen | 482/130 |
| 2010/0311552 | A1 | 12/2010 | Sumners et al. | |
| 2011/0251021 | A1 * | 10/2011 | Zavadsky et al. | 482/5 |
| 2013/0035219 | A1 * | 2/2013 | Williams et al. | 482/110 |
| 2014/0106948 | A1 * | 4/2014 | Agostini | 482/129 |
| 2014/0274600 | A1 * | 9/2014 | Dalebout et al. | 482/115 |

* cited by examiner

EXERCISE DEVICE WITH VIBRATION CAPABILITIES

RELATED APPLICATIONS

This application claims priority to U.S. Provisional Application No. 61/730,301, entitled EXERCISE DEVICE WITH VIBRATION CAPABILITIES, and filed on 27 Nov. 2012, which is incorporated herein in its entirety by this reference.

TECHNICAL FIELD

This disclosure relates generally to systems, methods, and devices for exercise. More particularly, the disclosure relates to exercise devices with vibration capabilities.

BACKGROUND

Physical exercise provides exercisers with numerous benefits, including aerobic conditioning, strength enhancement, weight loss, and rehabilitation. These benefits can be realized through various types of exercise, including strength training exercises. Additionally, recent research indicates that vibration therapy can also provide numerous benefits. Such benefits can include improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

Various devices have been developed to vibrate a person's body in an effort to realize the above noted benefits of vibration therapy. There have also been efforts made to incorporate vibration into more traditional exercise devices. U.S. Pat. No. 3,205,888, U.S. Pat. No. 4,958,832, U.S. Pat. No. 6,918,859, U.S. Pat. No. 7,166,067, U.S. Pat. No. 7,322,948, U.S. Pat. No. 7,871,355, U.S. Patent Publication No. 2007/0190508, U.S. Patent Publication No. 2008/0207407, U.S. Patent Publication No. 2008/0214971, U.S. Patent Publication No. 2008/0279896, U.S. Patent Publication No. 2009/0118098, U.S. Patent Publication No. 2010/0210418, and U.S. Patent Publication No. 2010/0311552 disclose examples of such vibration exercise devices.

SUMMARY OF THE INVENTION

In one example embodiment of the disclosure, an exercise device includes a frame, a cable and pulley system linked to the frame, and one or more vibration assemblies. The cable and pulley system includes at least one cable strand and at least one pulley. The at least one cable strand is movable in the performance of an exercise. At least one vibration assembly of the one or more vibrations assemblies is connected to the at least one pulley. The at least one vibration assembly selectively creates vibrations to cause the at least one cable strand to vibrate.

In another aspect that may be combined with any of the aspects herein, the exercise device also includes a first arm pivotally connected to the frame.

In another aspect that may be combined with any of the aspects herein, the exercise device also includes a second arm pivotally connected to the frame.

In another aspect that may be combined with any of the aspects herein, the at least one pulley comprises a first pulley mounted on the first arm and a second pulley mounted on the second arm.

In another aspect that may be combined with any of the aspects herein, the first pulley and the second pulley each have a cable strand associated therewith from the at least one cable strand.

In another aspect that may be combined with any of the aspects herein, the one or more vibration assemblies comprise a first vibration assembly connected to the first pulley and second vibration assembly connected to the second pulley to selectively vibrate the cable strands associated with the first pulley and the second pulley.

In another aspect that may be combined with any of the aspects herein, the first vibration assembly vibrates the first pulley and the second vibration assembly vibrates the second pulley.

In another aspect that may be combined with any of the aspects herein, the first vibration assembly vibrates the cable strand associated with the first pulley and the second vibration assembly vibrates the cable strand associated with the second pulley.

In another aspect that may be combined with any of the aspects herein, the first arm and the second arm may each be selectively repositioned between a plurality of positions.

In another aspect that may be combined with any of the aspects herein, at least one of the one or more vibration assemblies comprises a motor, a shaft rotatable by the motor about an axis of rotation, and one or more eccentric weights mounted on the shaft.

In another aspect that may be combined with any of the aspects herein, each of the one or more eccentric weights comprises a center of mass that is offset from the axis of rotation.

In another aspect that may be combined with any of the aspects herein, rotation of the shaft about the axis of rotation causes the centers of mass of the one or more eccentric weights to revolve around the axis of rotation, thereby creating the vibrations.

In another aspect that may be combined with any of the aspects herein, an intensity or frequency of the vibrations may be selectively controlled by adjusting the speed at which the centers of mass of the one or more eccentric weights revolve around the axis of rotation.

In another aspect that may be combined with any of the aspects herein, the exercise device also includes a control panel mounted on the frame.

In another aspect that may be combined with any of the aspects herein, the control panel has one or more user inputs.

In another aspect that may be combined with any of the aspects herein, the control panel is in electrical communication with the one or more vibration assemblies such that the one or more vibration assemblies are controllable by activating the one or more user inputs.

In another aspect that may be combined with any of the aspects herein, the exercise device also includes a resistance assembly.

In another aspect that may be combined with any of the aspects herein, the resistance assembly is adjustable to enable selective adjustment of a level of resistance provided by the resistance assembly.

In another aspect that may be combined with any of the aspects herein, an intensity or frequency of the vibrations is related to the level of resistance provided by the resistance assembly.

In another aspect that may be combined with any of the aspects herein, at least one of the one or more vibration assemblies comprises a motor, a shaft rotatable by the motor about an axis of rotation, and one or more cams mounted on the shaft, each of the one or more cams being selectively rotatable to periodically engage the at least one cable strand.

In another aspect that may be combined with any of the aspects herein, the exercise device also includes at least one of a seat, a backrest, and a bench.

In another aspect that may be combined with any of the aspects herein, a first arm is pivotally connected to the frame.

In another aspect that may be combined with any of the aspects herein, the first arm has a first pulley mounted thereon and a first cable strand associated therewith.

In another aspect that may be combined with any of the aspects herein, a second arm pivotally connected to the frame.

In another aspect that may be combined with any of the aspects herein, the second arm having a second pulley mounted thereon and a second cable strand associated therewith.

In another aspect that may be combined with any of the aspects herein, a resistance assembly is connected to the first and second cable strands.

In another aspect that may be combined with any of the aspects herein, one or more vibration assemblies selectively create vibrations to cause at least one of the first pulley and the second pulley to vibrate.

In another aspect that may be combined with any of the aspects herein, at least one of the one or more vibration assemblies includes a motor; a shaft rotatable by the motor about an axis of rotation; and one or more eccentric weights fixedly mounted on the shaft such that rotation of the shaft causes the one or more eccentric weights to rotate about the axis of rotation, each of the one or more eccentric weights having a center of mass that is radially offset from the axis of rotation.

In another aspect that may be combined with any of the aspects herein, vibration of the first pulley causes the first cable strand to vibrate and vibration of the second pulley causes the second cable strand to vibrate.

In another aspect that may be combined with any of the aspects herein, a resistance level of the resistance assembly is selectively adjustable.

In another aspect that may be combined with any of the aspects herein, an exercise device includes a cable and pulley system linked to the frame.

In another aspect that may be combined with any of the aspects herein, the cable and pulley system includes at least one cable strand and at least one pulley, the at least one cable strand being movable in the performance of an exercise.

In another aspect that may be combined with any of the aspects herein, one or more vibration assemblies selectively create vibrations to cause the at least one cable strand to vibrate.

In another aspect that may be combined with any of the aspects herein, at least one of the one or more vibration assemblies includes: a motor; a shaft rotatable by the motor about an axis of rotation; and one or more cams fixedly mounted on the shaft such that rotation of the shaft causes the one or more cams to rotate about the axis of rotation, wherein rotation of the one or more cams causes the one or more cams to periodically engage the at least one cable strand to vibrate the at least one cable strand.

In another aspect that may be combined with any of the aspects herein, the one or more vibration assemblies are mounted on the at least one pulley.

DETAILED DESCRIPTION

Figure 1:
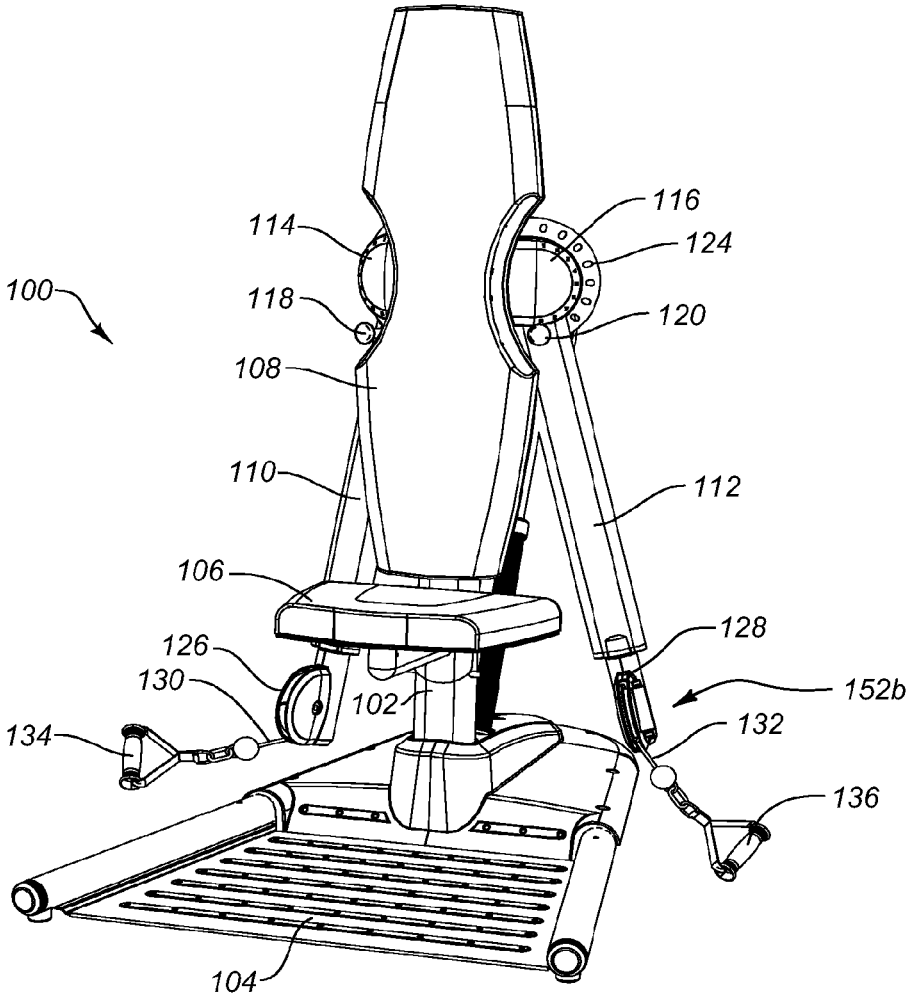
FIG. 1 illustrates a perspective view of an exercise device according to one example embodiment of the present invention.

The present disclosure is directed to systems, methods, and devices for exercise that include vibration capabilities. Depicted in FIGS. 1-7 are representations of one illustrative exercise device 100, which may incorporate the novel features of the present invention, including various novel devices, functionalities, hardware and software modules, and the like. As shown, exercise device 100 is depicted as a strength machine.

In the illustrated embodiment, as shown in FIGS. 1-4, exercise device 100 comprises a frame 102, a base plate 104, a seat 106, a backrest 108, and arms 110 and 112 that can be rotated and positioned according to the user's wishes for a desired exercise. Each arm 110 and 120 is movably connected to frame 104 by means of respective "shoulders" or flanges 114 and 116 are adjustable by means of respective knobs 118 and 120 that move into and out of holes 122 and 124 located on flanges 114 and 116, respectively. Arms 110 and 112 further respectively comprise pulleys 126 and 128 attached at their distal ends, cable strands 130 and 132, and handles 134 and 136 attached to cable strands 130, 132, respectively, for performing arm-related exercises.

Figure 2:
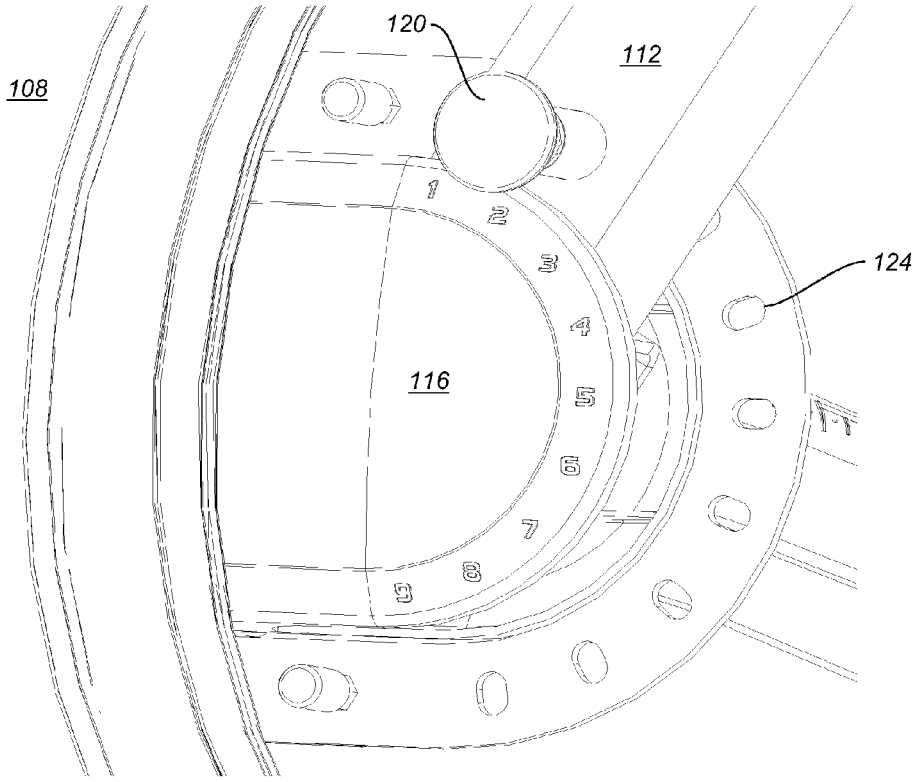
FIG. 2 illustrates an enlarged, cut-away view of the area where an arm connects to a flange on the backrest of the exercise device of FIG. 1.

FIG. 2 shows an enlarged, cut-away view of the area where arm 112 connects to flange 116 on backrest 103 by means of the adjustment knob 120, flange 116 and its holes 124. Arm 112 is pivotally connected to flange 116. When adjustment knob 120 is moved out of one of holes 124, arm 112 may be selectively pivoted to a desired orientation. Once arm 112 is in the desired orientation, knob 120 may be moved back into one of holes 124 to selectively secure arm 112 in place. Arm 110 connects to flange 114 in the same manner.

Figure 3:
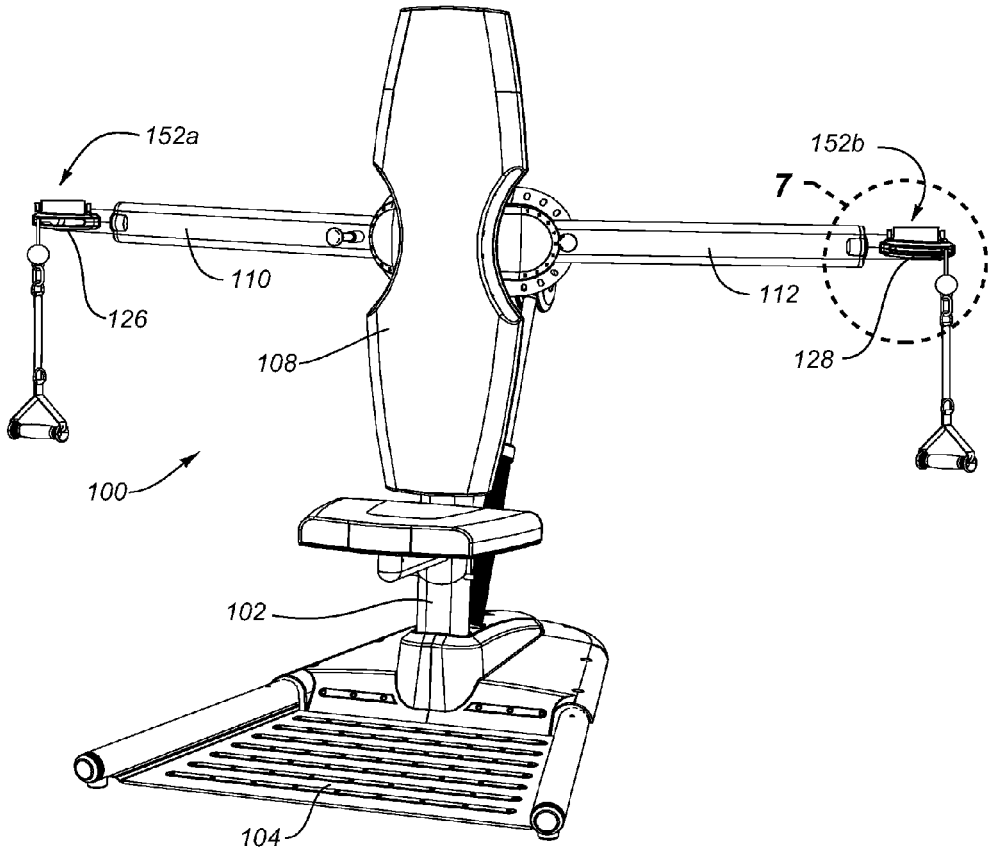
FIG. 3 illustrates a perspective view of the exercise device of FIG. 1 with arms in alternative positions.
Figure 4:
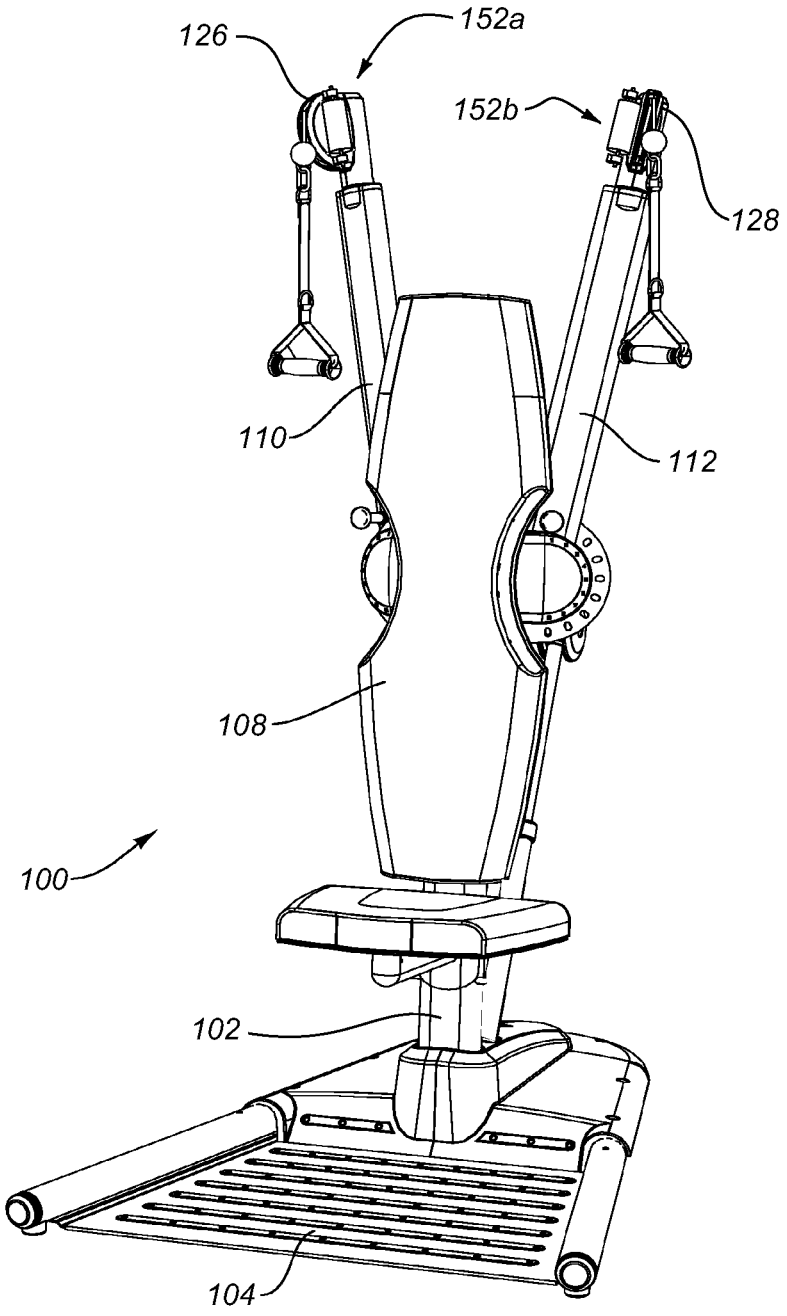
FIG. 4 illustrates a perspective view of the exercise device of FIG. 1 with the arms in other alternative positions.
Figure 5:
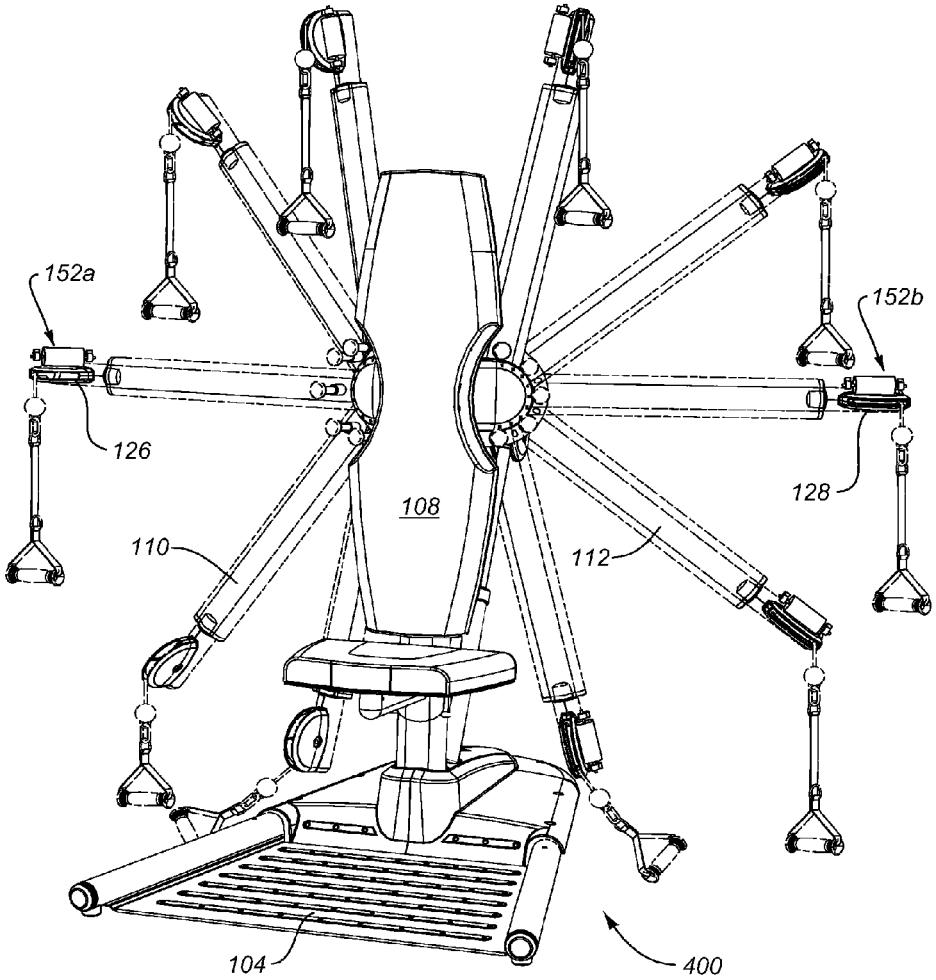
FIG. 5 illustrates a perspective view of the exercise device of FIG. 1 depicting the arms in various possible locations for different exercises.

FIG. 3 shows another perspective view of exercise device 100 of FIG. 1. In FIG. 3, arms 110 and 112 have been rotated differently from that of FIG. 1 so that they form about a 180 degree angle and are in position for a different exercise. FIG. 4 shows another perspective view of exercise device 100. In FIG. 4, arms 110 and 112 have been rotated differently from that of FIGS. 1 and 3 so that they are in position for yet a different exercise. FIG. 5 shows another perspective view of exercise device 100 with various possible locations in which arms 110 and 112 may be rotated and positioned for different exercises.

Figure 6:
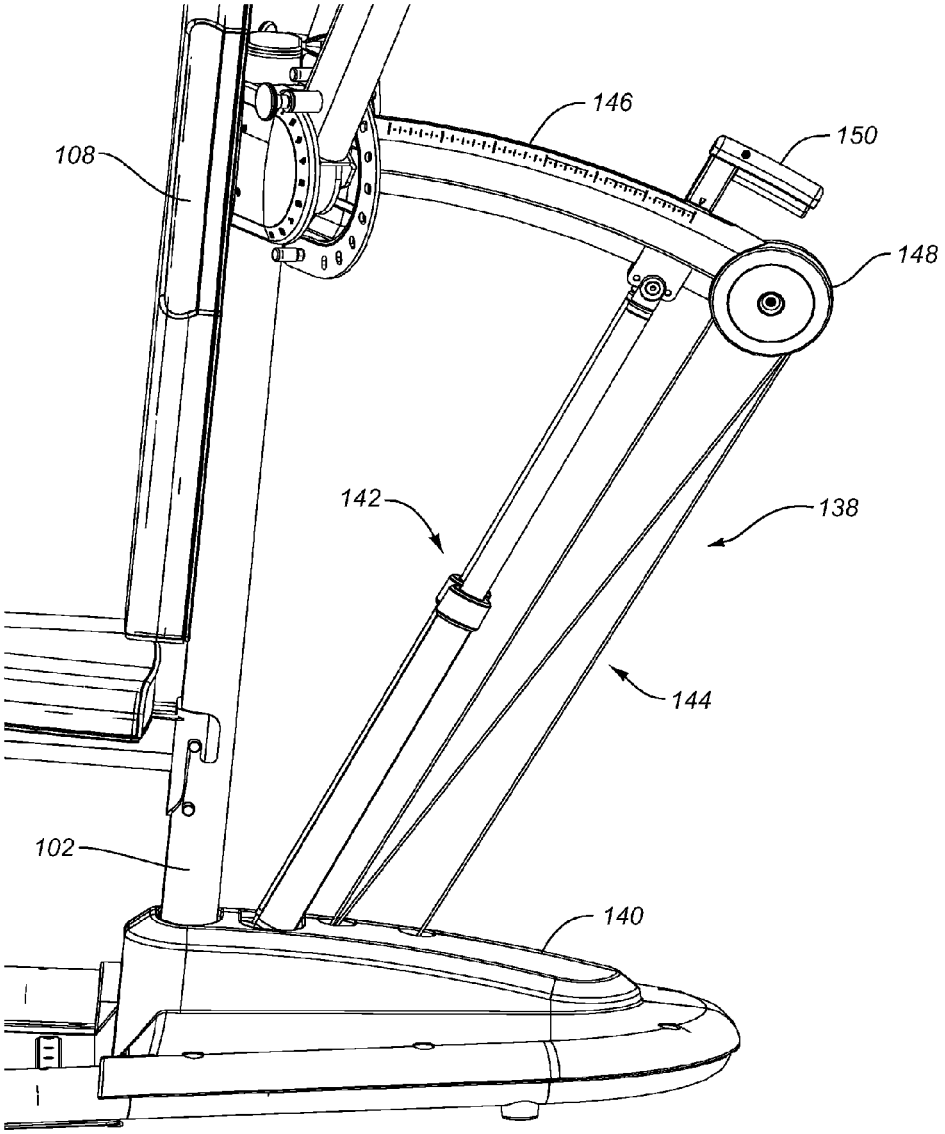
FIG. 6 illustrates an enlarged view of a resistance assembly of the exercise device of FIG. 1.

FIG. 6 shows an enlarged view of a resistance assembly 138 of exercise device 100 of FIG. 1, which includes a cutaway side view of the rear area of exercise device 100 where the user can adjust the resistance level on exercise machine 100. FIG. 6 shows a rear base 140, frame 102, backrest 108, and resistance assembly 138, which comprises two gas springs 142, cable strands 144, resistance arm 146, a pulley 148, and an adjustment handle 150.

One option for increasing the amount of resistance provided by resistance assembly 138 includes the user squeezing adjustment handle 150 and moving handle 150, which is connected to gas springs 142, along adjustment arm 146 and away from backrest 108, and then releasing handle 150 in the desired position on adjustment arm 146. To decrease the amount of resistance, the user can squeeze handle 150 and move handle 150 toward backrest 108, and then release handle in the desired location on adjustment arm 146. Note that cable strands 144 and cable strands 130 and 132 may be part of the same cable, all interconnected for the performance of exercises. In the illustrated embodiment, for example, strands 144 are connected to cables 130 and 132 through rear base 140 and frame 102, as shown in FIG. 6.

It is understood that resistance assembly 138 may include various types of resistance mechanisms for providing resistance to the performance of exercises. By way of example, in addition or as an alternative to using gas springs, resistance mechanism 138 may include shocks, elastic bands, metallic springs, motors, brakes (e.g., mechanical, frictional, electric, electro-mechanic, magnetic, electromagnetic), weights, and the like.

Exercise device 100 may also have the capability to vibrate certain portions of exercise device 100. For instance, exercise device 100 may include one or more vibration assemblies 152 connected thereto and which vibrate one or more parts of exercise device 100. In the embodiment illustrated in FIGS. 1 and 3-5, for instance, exercise device 100 includes two vibration assemblies 152. More specifically, a vibration assembly 152*a* is connected to pulley 126 and a vibration assembly 152*b* is connected to pulley 128.

When activated, vibration assemblies 152*a*-152*b* may cause all or certain portions of exercise device 100 to vibrate. For instance, vibration assembly 152*a* may cause pulley 126 to vibrate, which vibrations may be transferred through cable strand 130 and handle 134 and into a user's right hand and arm. Similarly, vibration assembly 152*b* may cause pulley 128 to vibrate, which vibrations may be transferred through cable strand 132 and handle 136 and into a user's left hand and arm. Accordingly, vibration assemblies 152*a*-152*b* may vibrate individual parts of exercise device 100.

In other embodiments, one or more of vibration assemblies 152 may vibrate specific areas of exercise device 100. For instance, one or more vibration assemblies 152 may vibrate frame 102 and components connected thereto (e.g., seat 106, backrest 108). In other embodiments, one or more vibration assemblies 152 may vibrate arms 110, 112 and components connected thereto (e.g., pulleys 126, 128, handles 130, 132). In still other embodiments, one or more vibration assemblies 152 may vibrate the entirety of exercise device 100. Thus, exercise device 100 may include a vibration assembly that vibrates a specific portion of exercise device 100, multiple vibration assemblies that vibrate multiple specific portions of exercise device 100, or one or more vibration assemblies that vibrate all or a substantial portion of exercise device 100.

Figure 7:
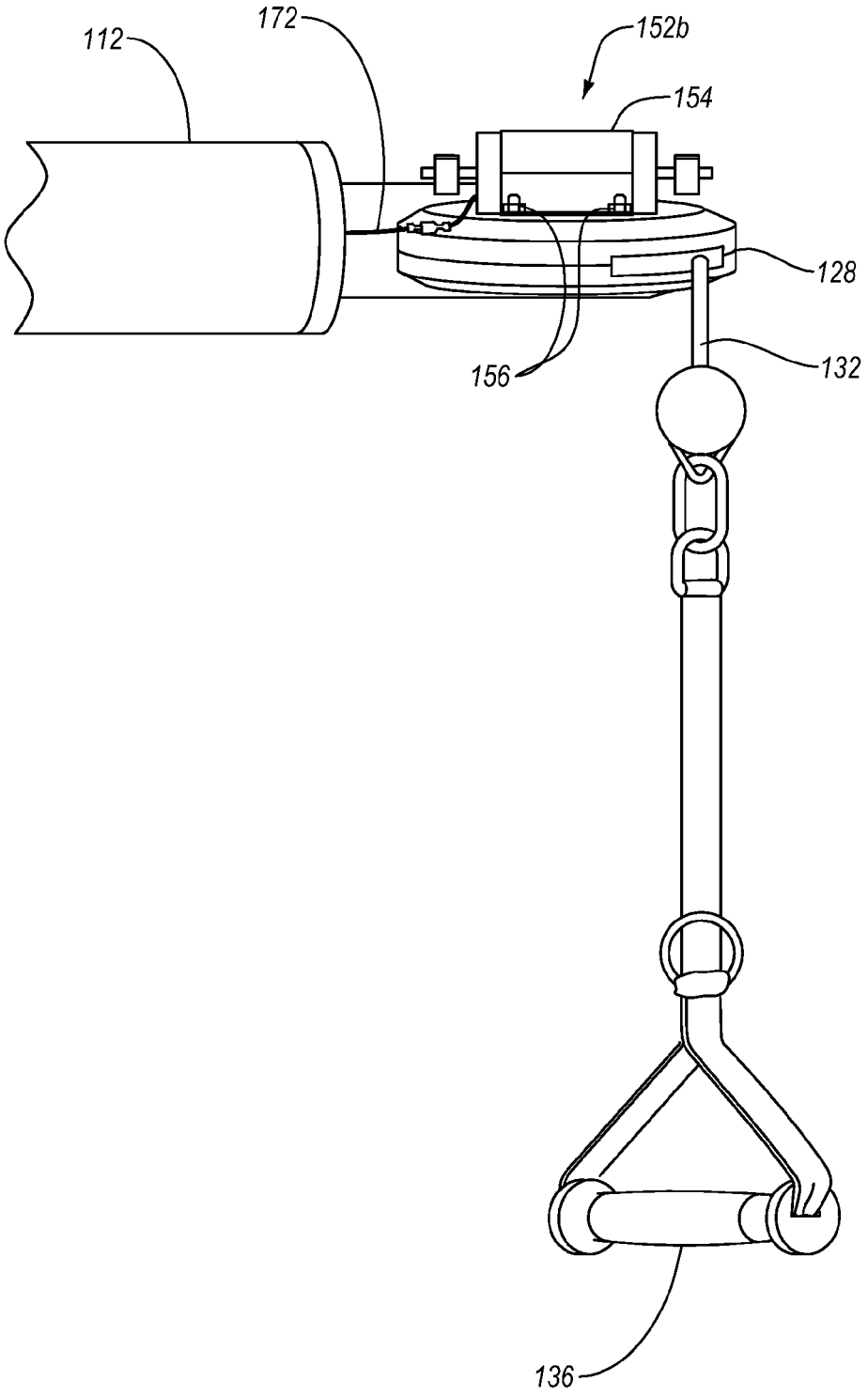
FIG. 7 illustrates a close up view of a vibration assembly connected to the exercise device of FIG. 1.
Figure 8:
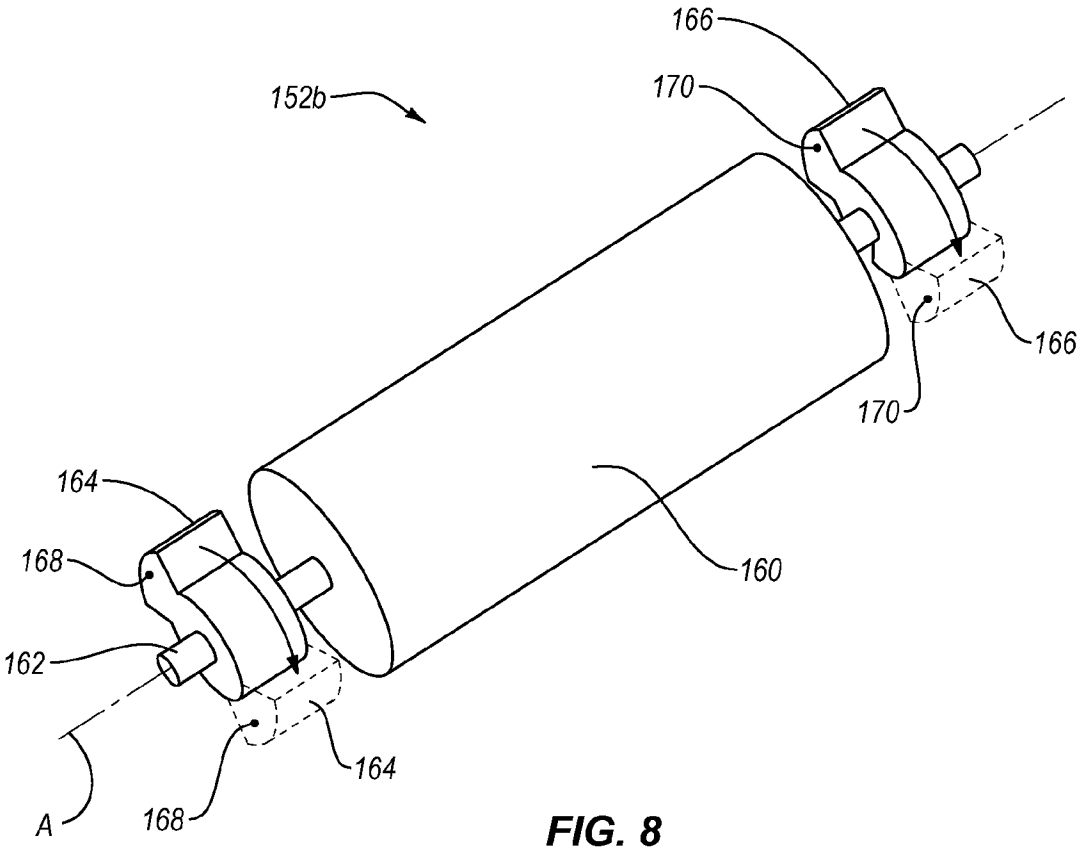
FIG. 8 illustrates the vibration assembly of FIG. 7 separate from exercise device of FIG. 1.

FIGS. 7 and 8 illustrate vibration assembly 152*b* in greater detail. It is understood that vibration assembly 152*a* may be similar or identical to vibration assembly 152*b*. Accordingly, the following discussion of vibration assembly 152*b* is equally applicable to vibration assembly 152*a*. In FIG. 7, a close up view of vibration assembly 152*b* is shown mounted to pulley 128. Mounting vibration assembly 152*b* on pulley 128 may maximize the amount of vibration transferred to a user's hand and arm (via cable strand 132 and handle 136). As can be seen in FIG. 7, vibration assembly 152*b* is connected to pulley 128 with a bracket 154 and bolts 156. In FIG. 8, vibration assembly 152*b* is shown separate from exercise device 100.

According to the illustrated embodiment, vibration assembly 152*b* includes a motor 160, a shaft 162, and eccentric weights 164, 166. Shaft 162 extends through motor 160 such that motor 160 is able to rotate shaft 162 about a longitudinal axis A of shaft 162. Each of eccentric weights 164, 166 has a center of mass that is offset from shaft 162 and axis A. For instance, eccentric weights 164, 166 may have centers of mass 168, 170, respectively.

In the illustrated embodiment, eccentric weights 164, 166 are fixedly mounted on opposing ends of shaft 162. As a result, when shaft 162 is rotated by motor 160, eccentric weights 164, 166 likewise rotate about axis A. For instance, in FIG. 8, eccentric weights 164, 166 are shown in solid lines in a first position. Eccentric weights 164, 166 are also shown in dashed lines in a second position after eccentric weights 164, 166 are rotated partially about axis A. As can be seen, as eccentric weights 164, 166 rotate, centers of mass 168, 170 revolve about axis of rotation A. The movement of centers of mass 168, 170 about axis A causes vibration assembly 152*b* to vibrate. Because vibration assembly 152*b* is mounted to pulley 128, the vibrations from vibration assembly 152*b* are transferred to pulley 128, thereby causing cable strand 132 and handle 136 to vibrate. Likewise, the vibrations from vibration assembly 152*a* are transferred to the parts of exercise device 100 to which they are attached (e.g., pulley 126, cable strand 130, and handle 134).

The intensity and frequency of the vibrations are a result of a number of different variables, including the speed at which the eccentric weights 164, 166 rotate, the distance between axis A and centers of mass 168, 170, and the size of eccentric weights 164, 166. The intensity and/or frequency of the vibrations can be increased by increasing the rotational speed of eccentric weights 164, 166, increasing the distance between axis A and centers of mass 168, 170, and/or increasing the size of eccentric weights 164, 166. Conversely, the intensity and/or frequency of the vibrations can be decreased by decreasing the rotational speed of eccentric weights 164, 166, decreasing the distance between axis A and centers of mass 168, 170, and/or decreasing the size of eccentric weights 164, 166.

Vibration assemblies 152*a*-152*b* may also be connected to a controller and/or a control panel. For instance, as shown in FIG. 7, vibration assembly 152*b* is connected to a controller and/or a control panel via wires 172. Connecting vibration assemblies 152*a*-152*b* to a controller enables the controller to control the operation of vibration assemblies 152*a*-152*b*, including such things as turning vibration assemblies 152*a*-152*b* on and off, controlling the speed at which the eccentric weights are rotated, and which direction the eccentric weights are rotated. Similarly, connecting vibration assemblies 152*a*-152*b* to a control panel enables a user of exercise device 100 to selectively control the operation of vibration assemblies 152*a*-152*b* at the control panel. For instance, a user may activate one or more inputs on the control panel to turn one or more of vibration assemblies 152*a*-152*b* on or off, adjust the speed at which the eccentric weights of each vibration assembly are rotated, and/or alter the direction the eccentric weights rotate.

Figure 9:
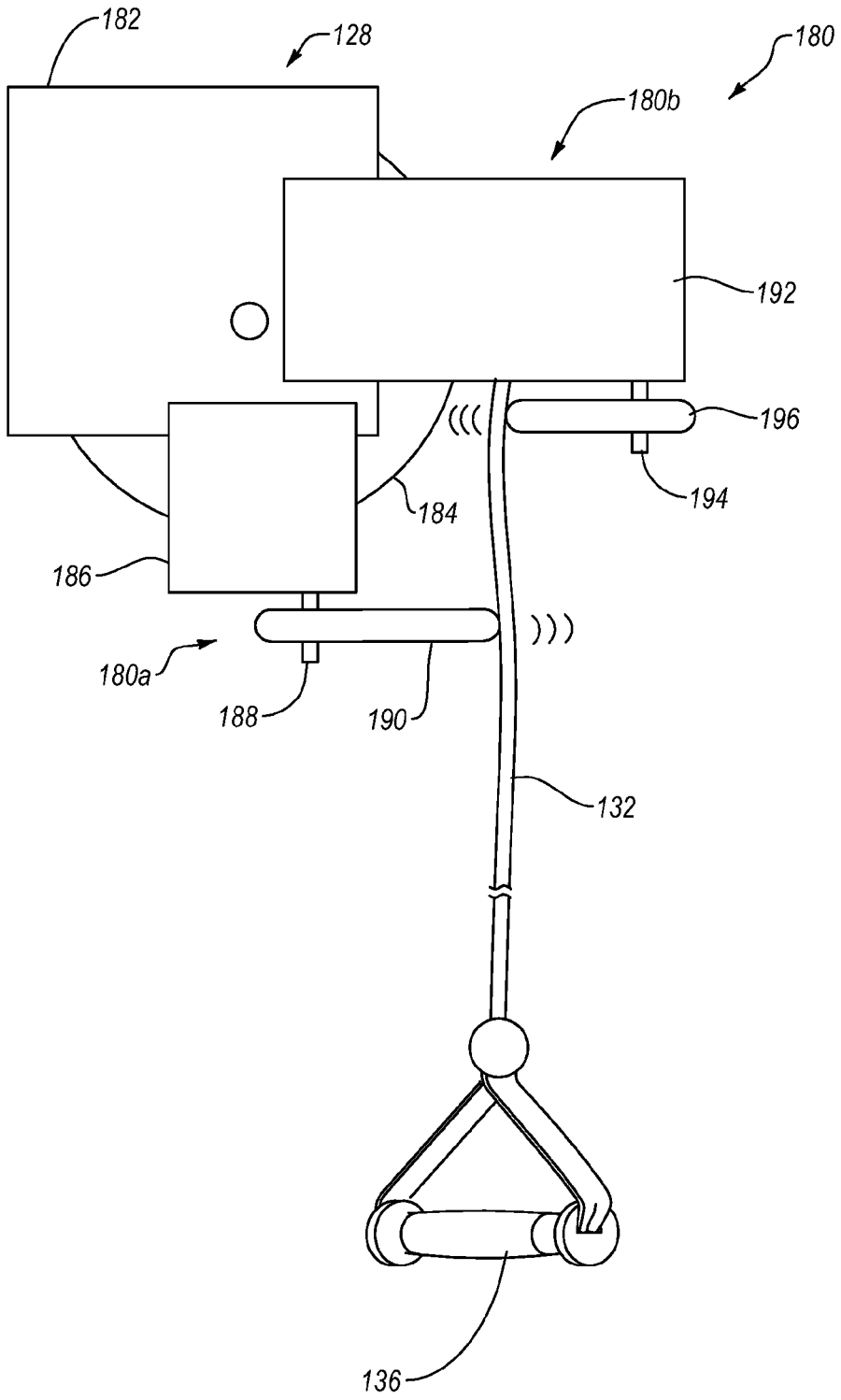
FIG. 9 illustrates a close view of an alternative vibration assembly for use with the exercise device of FIG. 1.

Turning attention to FIG. 9, there is illustrated an alternative embodiment of a vibration assembly 180 that may be used in connection with exercise device 100. As can be seen, vibration assembly 180 includes a first vibration assembly 180*a* and a second vibration assembly 180*b*. Similar to vibration assembly 152*b*, vibration assemblies 180*a*-180*b* are mounted on pulley 128.

Pulley 128 includes a housing 182 and a wheel 184 rotatably mounted therein. Vibration assemblies 180*a*-180*b* are mounted on or connected to housing 182. More specifically, vibration assembly 180*a* includes a motor 186 mounted on housing 182. Extending from motor 186 is a shaft 188 with a cam 190 mounted thereon. Motor 186 is capable of rotating shaft 188. Rotation of shaft 188 causes cam 190 to likewise rotate. As shaft 188 rotates cam 190, cam 190 periodically engages cable strand 132. The periodic engagement of cam 190 and cable strand 132 causes cable strand 132 to vibrate. As discussed above, the vibrations in cable strand 132 can be transferred to a user's hand and arm.

Similar to vibration assembly 180*a*, vibration assembly 180*b* includes a motor 192 mounted on housing 182. Extending from motor 192 is a shaft 194 with a cam 196 mounted thereon. Motor 192 is capable of rotating shaft 194. Rotation of shaft 194 causes cam 196 to likewise rotate. As shaft 194 rotates cam 196, cam 196 periodically engages cable strand 132. The periodic engagement of cam 196 and cable strand 132 causes cable strand 132 to vibrate. As discussed above, the vibrations in cable strand 132 can be transferred to a user's hand and arm.

Various modifications to vibration assembly 180 are contemplated within the scope of the present invention. By way of non-limiting example, vibration assembly 180 may include one or both of vibration assemblies 180*a*, 180*b*. Additionally, each of vibration assemblies 180*a*, 180*b* may include one or more cams that rotate and periodically engage cable strand 132.

Figure 10A:
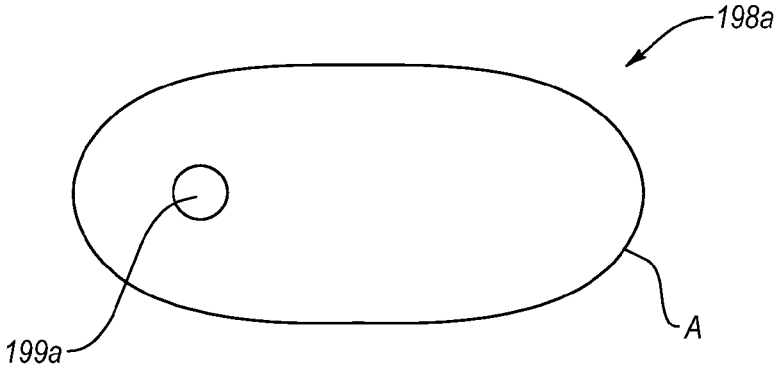
FIGS. 10A-10C illustrate top plan views of example cams that may be used in connection with the vibration assembly of FIG. 9.
Figure 10B:
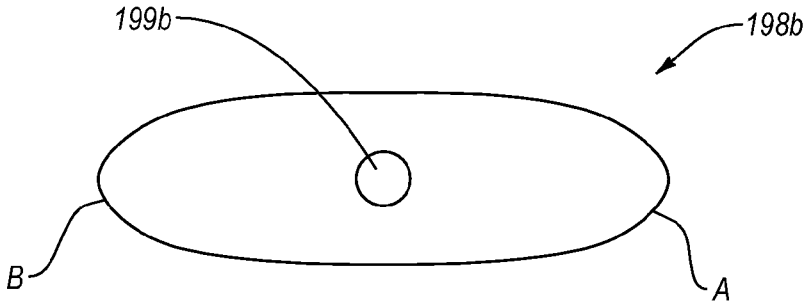
Figure 10C:
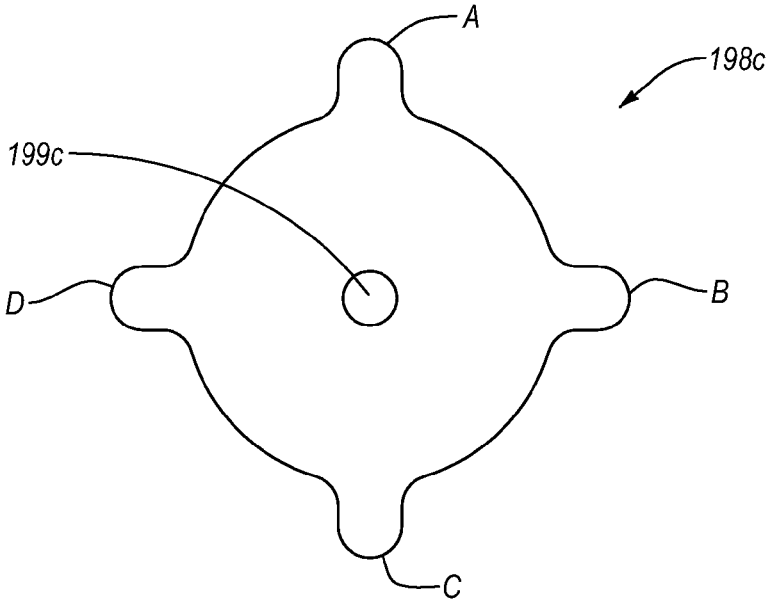

Cams 190 and 196 may take a variety of forms. FIGS. 10A-10C illustrate top plan views of various examples embodiments of cams that may be used in connection with vibration assembly 180. For instance, FIG. 10A illustrates a cam 198*a* that has a generally oval shape. As can be seen, cam 198*a* includes an opening 199*a* through which a shaft (e.g., shaft 188, 194) may be received and about which cam 198*a* may rotate. The offset placement of opening 199*a* in cam 198*a* enables end A of cam 198*a* to periodically engage a cable strand as cam 198*a* rotates. As noted, the periodic engagement of the cable strand by cam 198*a* causes the cable strand to vibrate, which vibrations may be transferred to a user's hand and arm through a handle.

Cam 198*b* shown in FIG. 10B is also generally oval shaped. In contrast to cam 198*a*, however, cam 198*b* includes an opening 199*b* that is generally centered in cam 198*b*. As a result, ends A and B of cam 198*b* engage a cable strand in an alternating fashion as cam 198*b* is rotated. The periodic engagement of ends A and B with the cable strand causes the cable strand to vibrate, which vibrations may be transferred to a user's hand and arm through a handle.

FIG. 10C illustrates yet another embodiment of a cam 198*c*. Cam 198*c* includes an opening 199*c* that is generally centered in cam 198*c*. Cam 198*c* is generally diamond shaped with nubs A, B, C, and D at the vertices. As cam 198*c* is rotated about opening 199*c*, nubs A, B, C, and D engage a cable strand, thereby causing the cable strand to vibrate.

Figure 11:
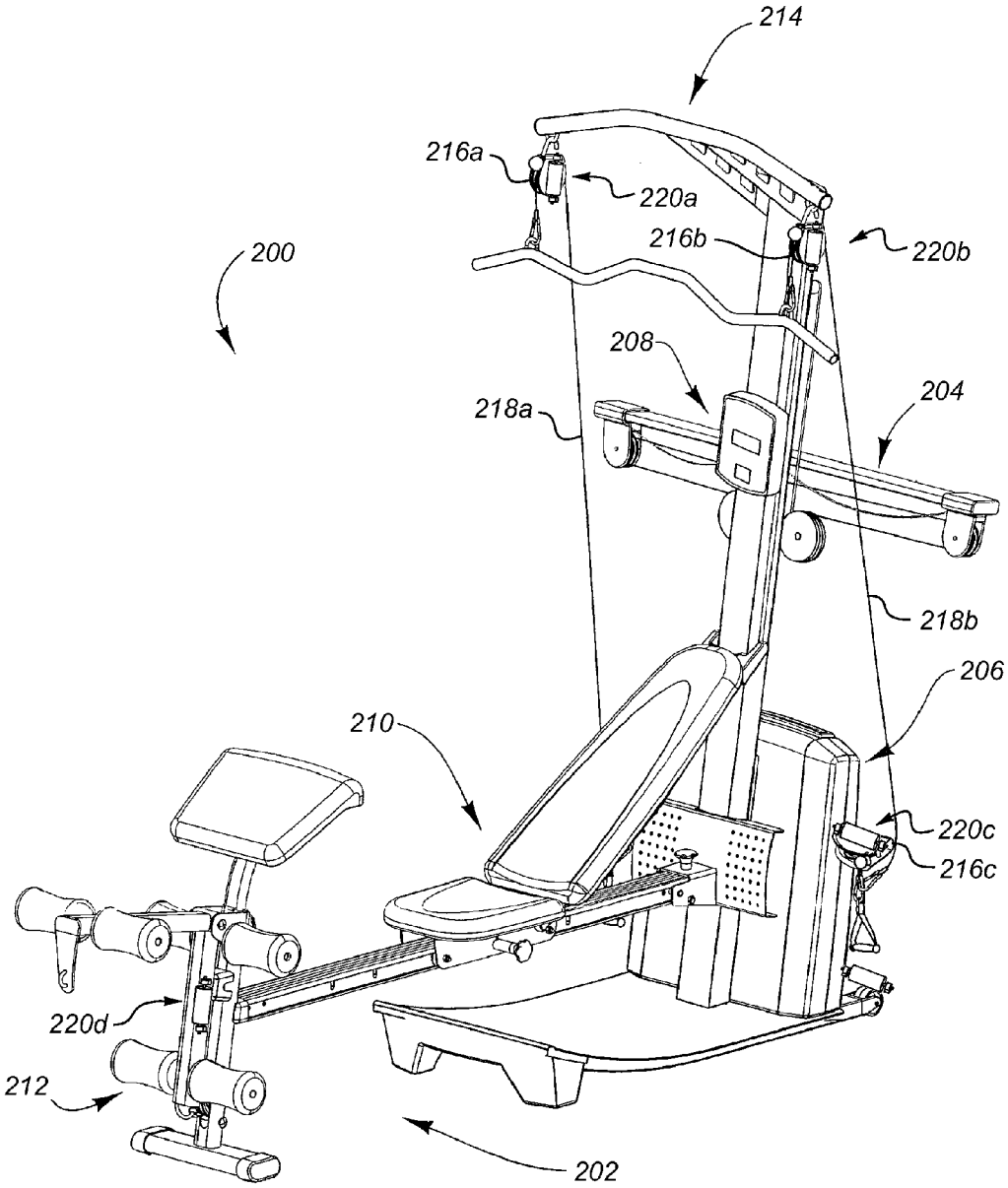
FIG. 11 illustrates a perspective view of an exercise device according to another example embodiment of the present invention

FIG. 11 illustrates a perspective view of an exercise device 200. Exercise device 200 is illustrated as an alternative embodiment of a strength machine. Exercise device 200 includes a support frame 202, a resistance assembly 204, a variable resistance system 206, and a weight selector controller 208. Exercise device 200 also includes a bench 210, a bicep/quadricep exerciser 212, and a lat tower 214. As will be appreciated by those skilled in the art, a variety of types and combinations of components can be utilized with the exercise apparatus without departing from the scope and spirit of the present invention.

As can be seen, resistance assembly 204 includes a cable and pulley system. More specifically, resistance assembly 204 includes a plurality of pulleys 216*a*-216*c* and cables strands 218*a*-218*b*. Like exercise device 100, exercise device 200 may also include one or more vibration assemblies 220*a*-220*d* for vibrating one or more parts of exercise device 200. For instance, as illustrated in FIG. 11, exercise device 200 includes a vibration assembly 220*a* connected to a first pulley 216*a*, a vibration assembly 220*b* connected to a second pulley 216*b*, a vibration assembly 220*c* connected to a third pulley 216*c*, and a vibration assembly 220*d* connected to bicep/quadricep exerciser 212. Vibration assemblies 220*a*-220*d* may selectively one or more of vibration pulleys 216*a*-216*c* and bicep/quadricep exerciser 212, which vibrations may be transferred to the user.

INDUSTRIAL APPLICABILITY

In general, embodiments of the present disclosure relate to systems and devices that impart vibrations to a user's body. More particularly, the systems and devices of the present disclosure impart vibrations to a user's body during the performance of an exercise. The exercise and the imparted vibrations can provide numerous benefits to the user, including aerobic conditioning, improved muscle strength and performance, increased bone density, stamina, flexibility, mobility, and coordination, enhanced critical blood flow throughout the body, relief of aches and pains, enhanced explosive strength, accelerated weight loss, decreased cortisol levels, increased production of serotonin and neurothrophine, and improved injury recovery.

The systems and devices of the present disclosure may include an exercise device in the form of a strength machine type exercise device. The exercise devices may include a frame and a cable and pulley system that a user engages to perform exercises. The exercise devices may also include resistance mechanisms for varying the level of resistance provided to the performance of the exercises.

The systems and devices of the present disclosure may also include one or more vibration assemblies that create vibrations that are imparted to the user during the performance of the exercise. Each of the one or more vibration assemblies may include a motor, such as a rotary motor, that rotates a shaft about an axis of rotation. The axis of rotation may be generally parallel to or collinear with a longitudinal axis of the shaft. One or more eccentric weights may be mounted on the shaft such that rotation of the shaft causes the one or more eccentric weights to rotate about the axis of rotation. Each of the one or more eccentric weights may have a center of mass that is offset from the axis of rotation. As a result of the offset between the centers of mass and the axis of rotation, rotation of the one or more eccentric weights creates vibrations that are transferred through the exercise device and into the user. In other embodiments, the vibration assembly motor may directly rotate the one or more eccentric weights without requiring the weights to be mounted on a shaft.

In addition or as an alternative to using eccentric weights to create the vibrations, the one or more vibration assemblies may include one or more cams that are rotated by the motor. As the cams are rotates, one or more portions of the cam may periodically engage the cable strands from the cable and pulley system, thereby vibrating the cable strand. The vibrations in the cable strands may be transferred to a user via one or more handles connected to the cable strands.

The one or more vibration assemblies may be connected to the exercise device such that the vibrations created by the one or more vibration assemblies are transferred to specific parts or the entirety of the exercise device. For instance, the one or more vibration assemblies may be rigidly connected to specific locations on the exercise device. Such locations may include on or near one or more of the pulleys, bicep/quadricep exerciser, frames, and handles. Accordingly, one or more vibration assemblies may be connected to the exercise device to vibrate one or more portions of the exercise device. The number of vibration assemblies used may depend on the size of the vibration assemblies used, the placement of the vibration assemblies on the exercise device, and/or the portions of the exercise device that are to be vibrated.

For instance, one relatively large vibration assembly may be connected to the frame. This arrangement may allow for the vibrations to spread through the frame and into the user by way of the seat or backrest. Alternatively, one or more vibration assemblies may be connected to the pulleys to vibrate the pulleys and/or the cable strands. Similarly, one or more vibration assemblies may be connected to the bicep/quadricep exerciser. Still further, multiple vibration assemblies may be connected to the exercise device at various locations to vibrate one or more portions of the exercise device.

In cases where multiple vibration assemblies are used, the vibration assemblies may be coordinated with one another to create vibrations with desired characteristics. For instance, the rotational speed and/or direction of the vibration assemblies may be coordinated to create vibrations with desired intensities and/or frequencies. More specifically, the rotational speed and/or direction of each vibration assembly may be controlled to generate the desired vibrations where the user contacts the exercise device. In other words, the rotational speed and/or direction of each vibration assembly may be controlled so that the vibrations from each vibration assembly either add to or partially cancel the vibrations from the other vibration assemblies to achieve the desired vibrations.

In addition or as an alternative to having rotating eccentric weights that create vibrations, the one or more vibration assemblies may include one or more rotating cams or other movable members that periodically engage, hit, or tap the exercise device or components thereof in order to create the vibrations in the exercise device.

In some embodiments, the intensity and/or frequency of the vibrations may be tied to other operating parameters of the exercise device. By way of non-limiting example, he intensity and/or frequency of the vibrations may increase or decrease as the resistance level of the resistance mechanism increases or decreases. Similarly, the intensity and/or frequency of the vibrations may be tied to speed at which the user is exercising.

What is claimed is:

1. An exercise device, comprising:

a frame;

a cable and pulley system linked to the frame, the cable and pulley system comprising:

at least one pulley, the at least one pulley including:

a pulley housing; and a wheel rotatably attached to the pulley housing;

at least one cable strand where the at least one cable strand is movable around the wheel of at least one pulley in the performance of an exercise; and one or more vibration assemblies, at least one vibration assembly of the one or more vibrations assemblies being connected directly to the pulley housing of the at least one pulley, wherein the at least one vibration assembly selectively creates vibrations to cause the at least one cable strand to vibrate;

wherein at least one of the one or more vibration assemblies comprises a motor, a shaft rotatable by the motor about an axis of rotation, and one or more cams mounted on the shaft, each of the one or more cams being selectively rotatable to periodically engage the at least one cable strand.

2. The exercise device of claim 1, further comprising:

a first arm pivotally connected to the frame; and a second arm pivotally connected to the frame.

3. The exercise device of claim 2, wherein the at least one pulley comprises a first pulley mounted on the first arm and a second pulley mounted on the second arm, the first pulley and the second pulley each having a cable strand associated therewith from the at least one cable strand.

4. The exercise device of claim 3, wherein the one or more vibration assemblies comprise a first vibration assembly connected to the first pulley and second vibration assembly connected to the second pulley to selectively vibrate the cable strands associated with the first pulley and the second pulley.

5. The exercise device of claim 4, wherein the first vibration assembly vibrates the first pulley and the second vibration assembly vibrates the second pulley.

6. The exercise device of claim 4, wherein the first vibration assembly vibrates the cable strand associated with the first pulley and the second vibration assembly vibrates the cable strand associated with the second pulley.

7. The exercise device of claim 2, wherein the first arm and the second arm may each be selectively repositioned between a plurality of positions.

8. The exercise device of claim 1, further comprising a control panel mounted on the frame, the control panel having one or more user inputs, the control panel being in electrical communication with the one or more vibration assemblies such that the one or more vibration assemblies are controllable by activating the one or more user inputs.

9. The exercise device of claim 1, further comprising a resistance assembly, the resistance assembly being adjustable to enable selective adjustment of a level of resistance provided by the resistance assembly.

10. The exercise device of claim 9, wherein an intensity or frequency of the vibrations is related to the level of resistance provided by the resistance assembly.

11. The exercise device of claim 1, further comprising at least one of a seat, a backrest, and a bench.

12. An exercise device, comprising:

a frame;

a first pulley and a second pulley where each of the first pulley and the second pulley include a pulley housing and a wheel rotatably attached to the pulley housing;

a first arm pivotally connected to the frame, the first arm having the first pulley mounted thereon and a first cable strand movable around the wheel of the first pulley;

a second arm pivotally connected to the frame, the second arm having the second pulley mounted thereon and a second cable strand movable around the wheel of the second pulley;

a resistance assembly connected to the first and second cable strands;

one or more vibration assemblies directly coupled to the pulley housing of the first and second pulleys respectively, wherein the one or more vibration assemblies selectively create vibrations to cause at least one of the first pulley and the second pulley to vibrate at least one of the one or more vibration assemblies comprising:

a motor;

a shaft rotatable by the motor about an axis of rotation; and one or more eccentric weights fixedly mounted on the shaft such that rotation of the shaft causes the one or more eccentric weights to rotate about the axis of rotation, each of the one or more eccentric weights having a center of mass that is radially offset from the axis of rotation.

13. The exercise device of claim 12, wherein vibration of the first pulley causes the first cable strand to vibrate and vibration of the second pulley causes the second cable strand to vibrate.

14. The exercise device of claim 12, wherein a resistance level of the resistance assembly is selectively adjustable.

15. An exercise device, comprising:

a frame;

a cable and pulley system linked to the frame, the cable and pulley system comprising:

at least one pulley, the at least one pulley including:

a pulley housing; and a wheel rotatably attached to the pulley housing;

at least one cable strand, the at least one cable strand being movable around the wheel of the at least one pulley in the performance of an exercise; and one or more vibration assemblies, wherein the one or more vibration assemblies is directly coupled to the pulley housing of the at least one pulley and selectively creates vibrations to cause the at least one cable strand to vibrate, at least one of the one or more vibration assemblies comprising:

a motor;

a shaft rotatable by the motor about an axis of rotation; and one or more cams fixedly mounted on the shaft such that rotation of the shaft causes the one or more cams to rotate about the axis of rotation, wherein rotation of the one or more cams causes the one or more cams to periodically engage the at least one cable strand to vibrate the at least one cable strand.

16. The exercise device of claim 15, wherein the one or more vibration assemblies are mounted on the at least one pulley.

* * * * *